US005333542A

United States Patent [19]

Lewis et al.

[11] Patent Number: 5,333,542

[45] Date of Patent: Aug. 2, 1994

[54] APPARATUS FOR COLLECTING AND COMPACTING ALUMINUM CANS

[76] Inventors: Lorne S. Lewis, 1597 Despard Avenue, Victoria, B.C., Canada, V8S 1T2; Gary W. Lewis, #206 555 Songhees, Victoria, B.C., Canada, V9A 6T3

[21] Appl. No.: 7,544

[22] Filed: Jan. 22, 1993

[51] Int. Cl.[5] ..... B30B 9/32; B30B 15/30

[52] U.S. Cl. ..... 100/45; 100/49; 100/266; 100/292; 100/902

[58] Field of Search ..... 100/45, 49, 99, 216, 100/265, 266, 292, 902

[56] References Cited

U.S. PATENT DOCUMENTS

| | | | |
|---|---|---|---|
| 3,517,607 | 6/1970 | Keagle | 100/45 X |
| 3,580,167 | 5/1971 | Simshauser | 100/902 X |
| 3,659,520 | 5/1972 | Garrett et al. | 100/902 X |
| 3,817,169 | 6/1974 | Bischoff | 100/902 X |
| 3,907,087 | 9/1975 | Tanaka | 100/902 X |
| 3,916,780 | 11/1975 | Heiser | 100/902 X |
| 4,141,493 | 2/1979 | Arp | 100/902 X |
| 4,216,713 | 8/1980 | Jung | 100/902 X |
| 4,235,164 | 11/1980 | Allen et al. | 100/902 X |
| 4,240,341 | 12/1980 | Whipple et al. | 100/902 X |
| 4,248,144 | 2/1981 | Morgan | 100/902 X |
| 4,261,259 | 4/1981 | Beardslee | 100/902 X |
| 4,291,618 | 9/1981 | Heiser et al. | 100/99 X |
| 4,296,683 | 10/1981 | Lidik et al. | 100/902 X |
| 4,316,410 | 2/1982 | Davis, Jr. | 100/902 X |
| 4,373,435 | 2/1983 | Grevich | 100/902 X |
| 4,403,545 | 9/1983 | Toburen et al. | 100/902 X |
| 4,436,026 | 3/1984 | Imamura et al. | 100/902 X |
| 4,444,100 | 4/1984 | Newman | 100/902 X |
| 4,453,459 | 6/1984 | Robbins | 100/902 X |
| 4,459,906 | 7/1984 | Cound et al. | 100/45 |
| 4,463,670 | 8/1974 | Thomas | 100/902 X |
| 4,463,844 | 8/1974 | Huffman et al. | 100/902 X |
| 4,469,212 | 9/1984 | DeWoolfson et al. | 100/902 X |
| 4,474,108 | 10/1984 | Lonze | 100/902 X |
| 4,480,737 | 11/1984 | Jamgochian et al. | 100/902 X |
| 4,493,251 | 1/1985 | Green | 100/292 X |
| 4,499,824 | 2/1985 | Elwing et al. | 100/902 X |
| 4,561,350 | 12/1985 | Snoe et al. | 100/902 X |
| 4,573,405 | 3/1986 | Morlock | 100/902 X |
| 4,606,265 | 8/1986 | Meier | 100/902 X |
| 4,653,627 | 3/1987 | Hampson et al. | 100/902 X |
| 4,667,593 | 5/1987 | Kennedy | 100/902 X |
| 4,722,269 | 2/1988 | Watkinson | 100/902 X |
| 4,771,685 | 9/1988 | Wagner | 100/902 X |
| 4,787,308 | 11/1988 | Newsom et al. | 100/45 X |
| 4,821,969 | 4/1989 | Fox et al. | 100/902 X |
| 4,953,682 | 9/1990 | Helbawi | 100/902 X |
| 4,962,701 | 10/1990 | Stralow | 100/902 X |
| 4,995,314 | 2/1991 | Buer | 100/902 X |
| 5,010,810 | 4/1991 | DeLorme | 100/902 X |
| 5,048,413 | 9/1991 | Deiters | 100/902 X |
| 5,067,398 | 11/1991 | Thoma | 100/902 X |

FOREIGN PATENT DOCUMENTS

| | | | |
|---|---|---|---|
| 1392203 | 2/1965 | France | 100/902 |
| 57-79100 | 5/1982 | Japan | 100/902 |
| 58-70995 | 4/1983 | Japan | 100/902 |
| 81/02802 | 10/1981 | PCT Int'l Appl. | 100/45 |

*Primary Examiner*—Stephen F. Gerrity
*Attorney, Agent, or Firm*—Hughes, Multer & Schacht

[57] ABSTRACT

Apparatus for collecting and storing empty aluminum containers for recycling. The containers are inserted into a chute having a regulating feed mechanism. The cans fall out of this one-by-one into a crushing zone between a reciprocating ram and a stationary platen, and interrupt a sensor beam which initiates the crushing cycle of the ram. After crushing, the cans drop into a container past the outer end of a can stop. The stop is counterbalanced so that empty cans will be retained in the crushing zone for flattening, while partially full containers displace this and fall through. The drive mechanism for the ram is provided by a compound eccentric cam having thrust and retraction faces, and first and second roller followers for engaging these. Preferably, the assembly is mounted in a cabinet for inclusion in a stand of vending machines.

24 Claims, 8 Drawing Sheets

22
32
20
24
40
78
46
82
84
42
88
212
114
130
110
132
100
106
128
180
124
126
26
154
60
52
64
190
192
210
160b
58
62
182
150
68
178
66
160d
54
28
70

APPARATUS FOR COLLECTING AND COMPACTING ALUMINUM CANS

FIELD OF THE INVENTION

The present invention relates generally to apparatus for compacting disposable containers, and, more particularly, to an automatic machine for collecting and crushing aluminum cans for subsequent recycling.

BACKGROUND OF THE INVENTION

In recent years there has been an increased emphasis on recycling certain materials. This makes particular sense with regard to aluminum containers, since this is economically attractive in terms of energy savings. Despite this, however, only a relatively small fraction of aluminum beverage cans are recovered after use, with the remainder being wastefully discarded. There may be several reasons for this, but one of the most significant is simply the absence of conveniently situated stations for receiving the empty containers and storing these in a compact space for periodic collection.

One of the most suitable locations for a collection station would be in association with vending machines which dispense drinks in aluminum containers. At such a location, the patrons could dispose of their empty cans in the collection station, and then these could be removed periodically by the same personnel who service the vending machines.

Vending machine stands generate a fairly large flow of empty cans, so a collection machine must be able to process these fairly expeditiously. Also, the empties tend to be generated in somewhat intermittent batches, as at the end of a lunch or break period, and so the machine must be able to accept a number of these being inserted in rapid succession. On the other hand, the volume is not so great as to warrant very high-speed, heavy-duty, complicated, and expensive equipment, nor would it warrant continuous operation of the machine. Furthermore, the machine must be able to operate in a relatively adverse environment with a minimum of service, being that collection of beverage cans is necessarily messy in nature, and numerous attempts to vandalize the mechanism can be expected. In short, the machine must be able to handle groups of cans inserted in rapid succession, and then remain shut down when no cans are being inserted, and must also be energy efficient and simple, rugged, and inexpensive in construction.

Numerous machines have been developed in the prior art for receiving and compacting empty aluminum containers. A number of these have been simple, hand-operated units which are simply impractical for a commercial installation of the type outlined above. On the other hand, many of the self-powered devices are designed for high-speed operation for crushing great numbers of cans on a more-or-less continuous basis, such as would be encountered at a municipal waste facility or full-time recycling operation. In general, these are simply too large and expensive and consume too much energy for installations of the type described above, and also frequently require the services of attendant personnel.

There are, however, a few automatic collection machines which have been developed in the prior art to receive and compact aluminum cans which are intermittently deposited by individual patrons. Examples of such machines are disclosed in U.S. Pat. Nos. 4,953,682, 4,499,824, and 4,469,212. However, these attempts have generally been hampered by serious deficiencies of one form or another. For example, the machine which is disclosed in U.S. Pat. No. 4,953,682 (Helbawi) represents a very complicated and expensive construction, and uses expensive and trouble-prone hydraulics for its crusher mechanism. U.S. Pat. No. 4,499,824 (Elwing et al.) and U.S. Pat. No. 4,469,212 (DeWoolfson et al.), in turn, are both deficient in that only one can can be inserted into the machine at a time, which is simply unacceptable for most applications. As for their crushing mechanisms, Elwing et al. again show the use of a relatively complicated system which employs expensive, problem-prone hydraulics, while DeWoolfson et al. disclose an electromechanical system which has the advantage of simplicity, but this uses components (e.g., a crank-driven piston rod) which are still somewhat expensive, and are subject to excessive wear and damage when used in a crushing application.

Accordingly, there exists a need for a machine for receiving empty aluminum cans from patrons in a vending machine area or the like, and for automatically compacting these for storage and subsequent collection. Furthermore, there exists a need for such a machine which is able to handle batches of such cans being inserted in rapid succession. Still further, there exists a need for such a machine which is simple, inexpensive, and durable in construction, yet which is also energy efficient and relatively maintenance-free in operation.

SUMMARY OF THE INVENTION

The present invention has solved the problems cited above, and is an apparatus for collecting and storing empty aluminum containers. Broadly, this comprises a reciprocating ram having a crushing platen mounted at a first end thereof and a second crushing platen mounted in opposition to the first crushing platen so as to define a vertically extending crushing zone. Means are provided for reciprocating the ram between a retracted position in which the crushing zone is opened to receive a container therein and an extended position in which the platens are brought together so as to crush the container. There is a feed chute for holding a plurality of the containers, this having a discharge end positioned vertically above the crushing zone, and also means for releasing the containers individually from the chute in response to the ram moving to the retracted position so that the cans fall vertically into the opened crushing zone one-by-one. Means are provided for retaining empty containers within the zone for crushing, and for releasing the containers after crushing so that these fall vertically out of the bottom of the crushing zone.

The means for reciprocating the ram may comprise a rotating cam and follower assembly. Preferably, this may be a compound eccentric cam comprising a first cam portion having a generally convex thrust cam face, and a second cam portion having a generally concave return cam face. A compound follower assembly is mounted to the end of the ram, and this comprises a first follower portion for engaging the convex thrust cam face so as to extend the ram in response to rotation of the cam to a first angular position, and a second follower portion for engaging the concave return cam face so as to retract the ram in response to rotation of the cam to a second annular position. The means for rotating the cam may preferably be an electric motor having a drive output shaft which is mounted eccentrically to the cam.

The second crushing platen may preferably comprise a generally planar plate member having a face for receiving the crushing force which is exerted by the reciprocating ram, and means for absorbing shock loading which is imparted to the plate member so as to reduce transmission of this loading into the drive mechanism for the ram. Preferably, this may comprise means for supporting the plate member for displacement by the shock loading, and at least one spring mounted against a second face of the plate member for compression as the plate member is displaced by the loading.

The second crushing platen may preferably further comprise first and second guide plates mounted to the plate member and extending from the first face of this; these guide plates are angled outwardly from the plate member along their vertically extending outer edges, and inwardly along their vertically extending inner edges, so as to form a V-shaped channel for guiding and holding the containers which fall vertically into the crushing zone. These guide plates are preferably yieldingly biased to form the V-shaped channel, so that the outwardly angled edges of these yield inwardly as a container is crushed against the second platen, until the guide plates lie generally flat against the face thereof.

The means for releasing the containers individually from the chute may comprise a stop having an inner end configured to arrest the containers in the chute, and means for alternately extending and withdrawing this from the interior passageway of the chute so that the containers fall out of this one-by-one. The means for extending and withdrawing the stop preferably comprises solenoid means for extending the end of the stop in response to an initiation signal, and for withdrawing the stop in response to a termination signal. The means for generating the initiation signal is preferably configured to do so in response to the container falling out of the lower end of the chute, and may comprise sensor means mounted in the lower end of the chute below the end of the stop. The sensor means may preferably comprise a light source for generating a beam across the lower end of the chute, and a light sensor for receiving this beam and generating the initiation signal in response to interruption of the beam by passage of a container therethrough. Preferably, the motor for reciprocating the ram through the crushing cycle is simultaneously actuated by the initiation signal.

Means are also preferably provided for generating the termination signal in response to the ram moving to the retracted position so as to open the crushing zone, and this may comprise an actuator member mounted to the end of the motor-driven output shaft, and a switch member configured to be actuated in response to the actuator member rotating with the shaft to a predetermined angular position.

The means for retaining empty containers in the crushing zone may preferably comprise means for retaining empty containers therein, and for permitting at least partially full containers to pass through the zone without crushing. This may comprise a swingarm assembly having a container stop which extends at least partway across a lower end of the crushing zone, this stop being configured to support the weight of an empty container which falls on this, but to deflect downwardly under the weight of a container which is at least partially full. This swingarm assembly may preferably comprise a swinging link having the container stop formed on a first end thereof, and a counterbalance mounted to a second end for yieldingly biasing the link to the position in which the stop extends across the lower end of the crushing zone.

DETAILED DESCRIPTION a. Overview

Figure 1:
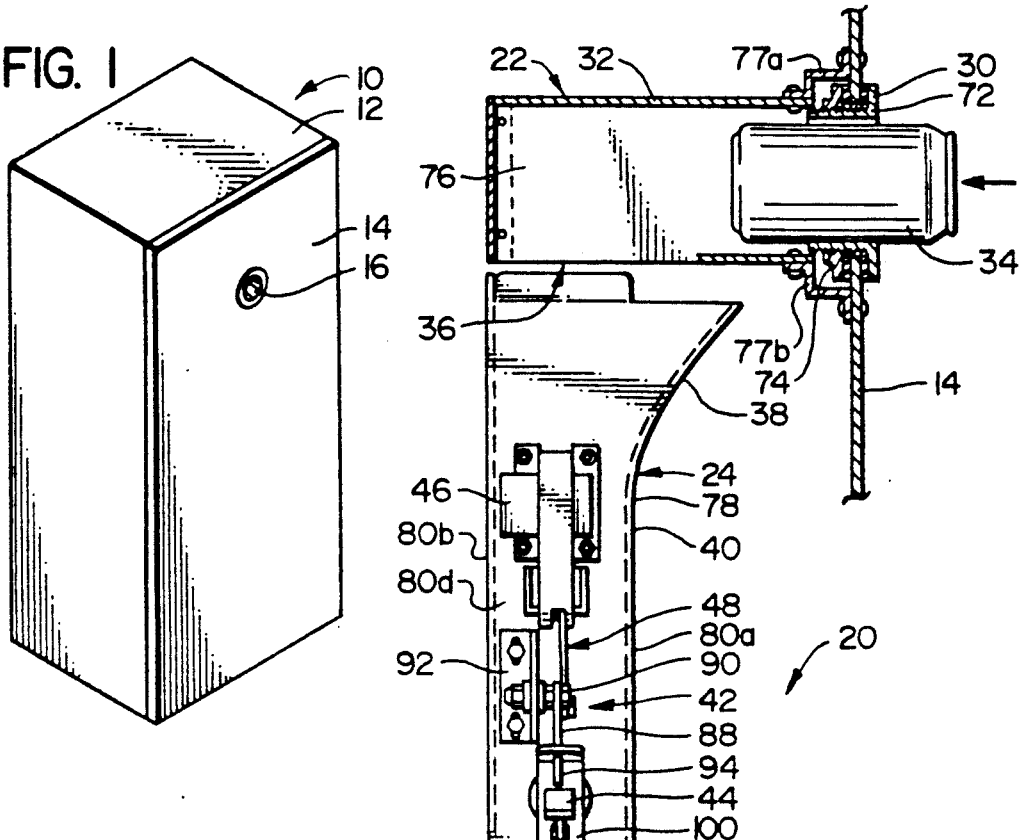
FIG. 1 is a perspective view of a can collecting and crushing machine which incorporates the present invention, this being mounted within a housing having external dimensions generally similar to those of a conventional vending machine.

FIG. 1 shows the exterior of a machine 10 in accordance with the present invention for receiving and compacting aluminum cans, and for holding these for subsequent collection. Machine 10 is provided with a generally rectangular housing 12; this may be provided by the casing of a scrapped vending machine, especially since this makes it very easy to incorporate the machine in a conventional vending stand. At the front of the housing 12 there is a side-hinged door 14, by which access to the interior may be gained. On the face of the door, towards its upper end, there is a circular opening 16 by which the empty aluminum cans enter the internal mechanism of the machine.

Figure 2:
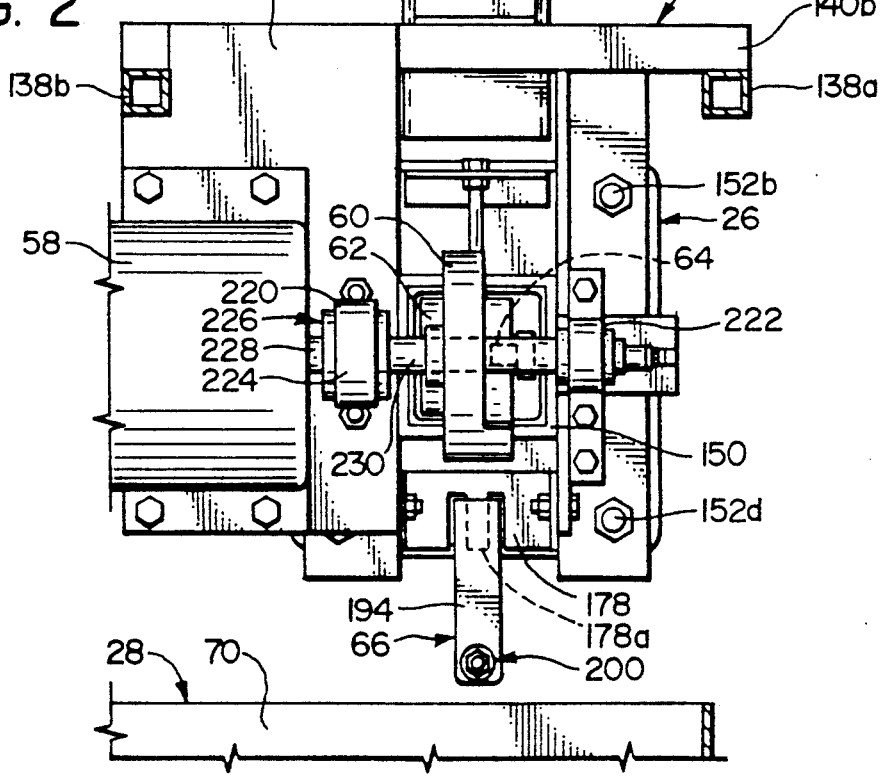
FIG. 2 is a side view, partly in section, showing the internal can crushing mechanism of the machine of FIG. 1.

FIG. 2 provides an overview of the assemblies which make up this internal mechanism 20. These comprise, progressing from top to bottom, an entry tube assembly 22, a guide chute assembly 24, a crusher mechanism assembly 26, and a container assembly 28. A brief overview of these assemblies will be provided here before proceeding to a more detailed description of the various components and their operation.

Entry tube assembly 22 is made up generally of an entry pipe portion 30 and a guide tube portion 32. The entry pipe portion forms the mouth opening in door panel 14 and extends inwardly from this. This has an inside diameter which closely corresponds to the standard diameter of aluminum beverage cans; this helps prevent unwanted objects from being inserted into the machine, and also excludes badly deformed cans which might interfere with the feed mechanisms.

Entry tube assembly 22 forms an elongate passageway through which the can passes, so as to bring the latter into vertical alignment over the guide chute assembly 24, where it drops through an entrance opening 36 at the upper end of this. At the opening there is a flared funnel portion 38 which aligns the can so that its axis extends in the vertical direction as it enters the main throat portion 40 of the chute. The vertical length of the main throat is such that it is able to accommodate several cans, stacked end-to-end, and there is a solenoid actuated feed mechanism 42 mounted to this for regulating the passage of the cans. As will be described in greater detail below, this is made up generally of a stop 44 which is operatively connected to the solenoid 46 by means of a linkage 48.

The feed mechanism regulates the passage of the cans through the chute, so that they leave this one-by-one and drop into the crusher mechanism assembly 26. As is also shown in FIG. 2, this assembly is supported in a framework 50 which is mounted to the main chassis of the machine 10, and is made up generally of a reciprocating ram 52 having an inner end which is positioned opposite a crusher plate subassembly 54 so as to define a vertically extending crushing zone 56. The ram 52 is reciprocated by an electric motor 58 which rotates a compound eccentric cam 60; as will be described below, the compound cam engages a relatively large thrust roller 62 on the ram subassembly during the extension stroke, and then engages a separate return arm roller 64 during the retraction stroke.

As the cans fall into the crushing zone 56, they are retained in position by a can stop subassembly 66. The end of this forms a trapfall stop 68; when the cans have been flattened against crusher plate 54, and then the crushing ram 52 begins to retract, these simply slip past the end of the stop and drop into the underlying container assembly 28. The latter may preferably comprise an inexpensive plastic garbage container 70, which makes it very easy to remove and transport the collected cans, and also eliminates leakage of residual liquids.

Having provided an overview of the complete internal mechanism 20, each of the major subassemblies which make this up will now be described in greater detail.

Entry Tube Assembly

The principal component of the entry pipe portion 30 is a threaded flange 72. This has an outer rim which engages the outer surface of the door panel 14, and a horizontally-extending cylindrical bore through which the cans pass as they enter the machine. The flange is retained to the door panel by a flared plastic nut 74 which is threaded onto its inner end so as to engage the inner surface of the panel. Both the nut and the flange may be plastic piping components. Suitable resilient washers (e.g., paper and/or rubber washers) may be mounted between the door panel and the rim portions of the tubular flange and nut so as to provide a secure installation.

As noted above, the diameter of the entry pipe bore corresponds very closely to the outside diameter of standard aluminum cans, and this serves several purposes: firstly, it helps exclude unwanted objects, and especially objects large enough to become jammed in the mechanism; secondly, it also helps exclude badly deformed cans which might interfere with the operation of the feed mechanism or other portions of the system; thirdly, the cylindrical bore provides an initial alignment of the cans so that these enter the entry tube and guide chute assemblies in a generally axial direction, so as to ensure orderly feeding of the cans through the system.

The second element of the entry tube assembly is the guide tube portion 32, and this comprises an elongate receiver 76 having exit opening 36 at its rearward end. The receiver may have a generally square cross-section, and may be made up of aluminum or other plates welded or riveted together; alternatively, this may be provided by a length of cylindrical pipe. The forward end of the receiver is mounted to the back side of door panel 14 by brackets 77*a*, 77*b*, so that its open forward end is aligned with the bore through entrance flange 72.

The passage through the receiver is slightly larger than the outside diameter of the cans so that these are kept aligned for axial movement through the receiver until they reach opening 36. At this point, the cans are "tipped up" by the lip of the opening as they fall out through this and into the guide chute assembly, thereby providing an initial rotation of the axes of the cans towards vertical alignment. The vertical alignment of the cans has been found to be highly advantageous, especially by comparison to a horizontal alignment, because this minimizes the sloshing or "free surface effect" of the residual liquid in the can, and so enhances the control and orderly handling of the containers.

Guide Chute Assembly

The main chute portion 78 of the assembly is also preferably made up of heavy-gauge aluminum or other sheet material secured together in the manner of an elongate, open-ended box. Accordingly, there are front and rear walls 80*a*, 80*b* and side walls 80*c*, 80*d* (see also FIG. 3). As was noted above, at the upper end of the chute assembly, these form a funnel portion 38: the front wall 80*a* bends forwardly towards the front door of the machine, and the side walls 80*c*, 80*d* flare somewhat outwardly beneath the sides of receiver 76. This consequently forms a downwardly tapering area for receiving the can as it drops out of the bottom opening 36 of the entry tube assembly and rotating the can into alignment for axial movement through the vertical chute; also, the flared upper end of the funnel helps catch a residual liquid which might enter along with the can so as to prevent this from running down the outside of the mechanism.

As was also noted above, the guide chute is sufficiently long to accommodate several (e.g., four or five) cans stacked end-to-end. The feed mechanism 42 is mounted partway down the length of the chute for regulating the passage of these cans through the assembly. The electric solenoid 46 which operates this is mounted to one of the side walls 80*d* of the chute, so that the actuator rod 82 thereof extends in a downward direction generally parallel to the chute. The end of this is axially connected to a straight link 84 which pivots back and forth slightly on the end of the actuator rod. The other end of the straight link is pivotally mounted to one arm 86 of a cranked link 88. This has two arms which extend at approximately 90° to one another, the link being mounted by a pivot pin 90 to a support bracket 92 so that the second arm 94 of the crank link moves outwardly and inwardly with respect to the chute as the solenoid rod is extended and retracted. The end of this second arm extends through a slot-shaped opening 96 formed in the upper end 98 of a pivoting draw link 100. The upper end of the draw link is bent slightly outwardly so that this engages the second arm of the cranked link more-or-less perpendicularly. A bracket portion 102 extends perpendicularly from the lower end of the draw link so as to lie parallel to a second support bracket 104 on the side wall of the chute, and is mounted to this by pivot pin 106. Accordingly, as actuator rod of a solenoid 46 is extended and retracted, the upper end of the draw link moves outwardly and inwardly relative to the chute as the lower end pivots about pin 106.

In the middle portion of the draw link (somewhat towards the upper end thereof), there is a second opening 108 which holds the reciprocating stop 44 of the feed mechanism. The stop is made up of an inner rod portion 110, which passes through the opening in the draw link and extends into the guide chute through a guide collar 112, and an L-shaped bracket portion 114 which is welded to the rod portion and extends outwardly therefrom. The shorter leg 116 of the bracket portion forms a stop which abuts the outer face of the draw link. The longer leg 118 extends outwardly from this and provides an attachment point for one end of a tensioning spring 120. The other end of the spring is attached to the middle portion of the draw link so as to keep the link and the bracket portion of the stop in firm abutment as the mechanism reciprocates.

A compression spring 122 is mounted around the rod portion of stop 44, between the draw link and an annular flange on guide collar 112. This biases the stop back to the retracted position during the return stroke, and also provides a "fail safe" mechanism, in that the spring will bias the stop to the open position in the event that the solenoid fails.

As the feed mechanism releases the cans one-by-one, these drop through the bottom portion of the guide chute and interrupt an infrared beam 124 between an IR light source 126 and detector 128 on opposite sides of the chute. As will be described below, the detector generates a signal in response to this which initiates actuation of the crusher assembly.

The chute portion 78 of the assembly is also provided with a cutaway portion 130 generally adjacent the mechanism, and an access plate 132 which at least partially covers this. The access plate is readily removable by undoing a wing nut 134 and lifting the plate out of a support channel 136, giving easy access to the interior for removal of jammed cans or other obstructions.

It should be noted that a number of modifications could be made to the chute assembly which is illustrated, if so desired. For example, while an electrically operated solenoid 46 is shown, some other form of actuator could be substituted for this, such as a hydraulic ram or a motor-driven linkage, for example. Similarly, some other light source and detector, or other detecting means (such as Hall-effect elements), could be substituted for the IR system which is illustrated.

Crusher Mechanism Assembly

As a can leaves the guide chute assembly, it drops into the jaws of the crusher mechanism. As was noted above, this is made up generally of a crusher plate subassembly, a reciprocating ram, and the electric motor which drives this.

The assembly is supported by a framework 50, which includes main supports **138*a*, 138*b* which extend out to the sides of the machine housing, and secondary support members 140*a*, 140*b* which interconnect these and provide a combined support for the motor mount and ram guide. Towards the rear of the assembly, there is a support bracket 142 which extends downwardly from support member 140*b* to carry motor 58, and towards the forward end of the assembly there are corresponding brackets 146 and 148 (see also FIG. 4) which extend downwardly from support member 140*a*. A hollow, square cross-section ram guide 150** is welded across these three brackets partway down their lengths, so that the axis of this extends in a horizontal direction, generally perpendicular to the axis of the chute assembly.

The crusher plate subassembly 54 is also supported off of forward brackets 146, 148, by means of a set of guide rods **152*a–b*. These extend parallel to one another and pass through cooperating bores in the four corners of the main platen 154 of the subassembly, so that the platen is free to move inwardly and outwardly on these with respect to the crushing zone 56. Movement in the inward direction is limited by stop nuts 156*a–d* which are threaded onto the guide rods to abut the inner face of the platen; additional nuts 158*a–d* are threaded onto the outer ends of the guide rods, and compression springs 160*a–d* are positioned on the guide rods between these and the outer face of platen 154, so as to yieldingly bias the platen inwardly. As will be described below, this enables the platen 154** to serve both as a crushing surface and something of a shock absorber.

The crusher plate sub-assembly also includes a pair of can guide wings **162*a*, 162*b*. Each of these is made up of a somewhat rectangular face plate which extends vertically along the face of platen 154. Upper and lower studs 164*a,b* and 166*a,b* extend from the inboard edges of these plates through cooperating bores in the platen. The ends of the upper and lower studs on each plate are joined on the opposite side of the platen by connection brackets 168*a,b*. These, in turn, provide attachment points for tension springs 178*a,b*, the other ends of which are attached to anchor bolts 172*a*, 172*b* on the back of the platen, outboard of the connection brackets. The tension springs thus draw the connection brackets away from one another; this causes the studs to which these are mounted to pivot in the bores in the platen, so that the inboard edges of the two guide wings 162*a*, 162*b*** are tilted towards the face of the platen, while the outboard edges of the wings are angled away from this.

Consequently, it will be understood than the guide wings **162*a*, 162*b***, in their initial configuration, provide a vertically-extending "V-shaped" channel (viewed from above) for centering of the can on the platen for crushing by the reciprocating ram. The upper edges of the two guide plates are also sloped downwardly toward the middle, so as to help guide the can into the V-shaped retaining area. When the can is crushed and flattened by the ram, the outboard edges of the guide wings yield back until the wings lie flat against the face of the platen. Then, as the ram is withdrawn, the spring-biased wings shove the flattened can off from the face of the platen, thus preventing the can from sticking to this due to liquid residues.

As for the crushing ram itself, this is provided with another crushing platen 178, which is positioned on the opposite side of the crushing zone from platen 154 and generally parallel to this. A rearwardly-extending shelf 180 on the upper edge of the platen 178 serves as a shield to prevent pull-tabs or other small articles from falling behind the platen and getting into the ram drive mechanism. The main thrust tube 182 of the ram extends from the back side of platen 178, and this fits closely within the interior of ram guide 150 so as to form a sliding bearing arrangement with this for supporting and guiding the ram as it reciprocates.

The roller followers of the ram drive mechanism extend from the rearward end of thrust tube 182. Firstly, the main thrust roller 62 is mounted inside the end of the thrust tube, on a relatively large (e.g. ½-inch dia.) axle pin 184, so that this protrudes of the end of the tube. The return arm roller 64, in turn, is mounted on a return arm 186, by a second axle pin 188, the forward end of which passes along side of the thrust roller and is mounted to the inside of the thrust tube forwardly of this.

As noted above, the thrust and return followers are alternatively engaged by the cam surfaces of the compound eccentric cam 60. This comprises a cylindrical main thrust cam face 190 having a convex outer surface, and a crescentic secondary return cam face 192 having a generally convex inner face. The cam 60 is driven by an electric motor 58, and this is preferably of the type which applies braking action to its output shaft when power is secured. A Dayton½ ¼-hp gear motor has been found eminently suitable for this purpose. If desired, other motive means may of course be used in place of the electric motor such as a hydraulically operated motor for example.

Figure 3:
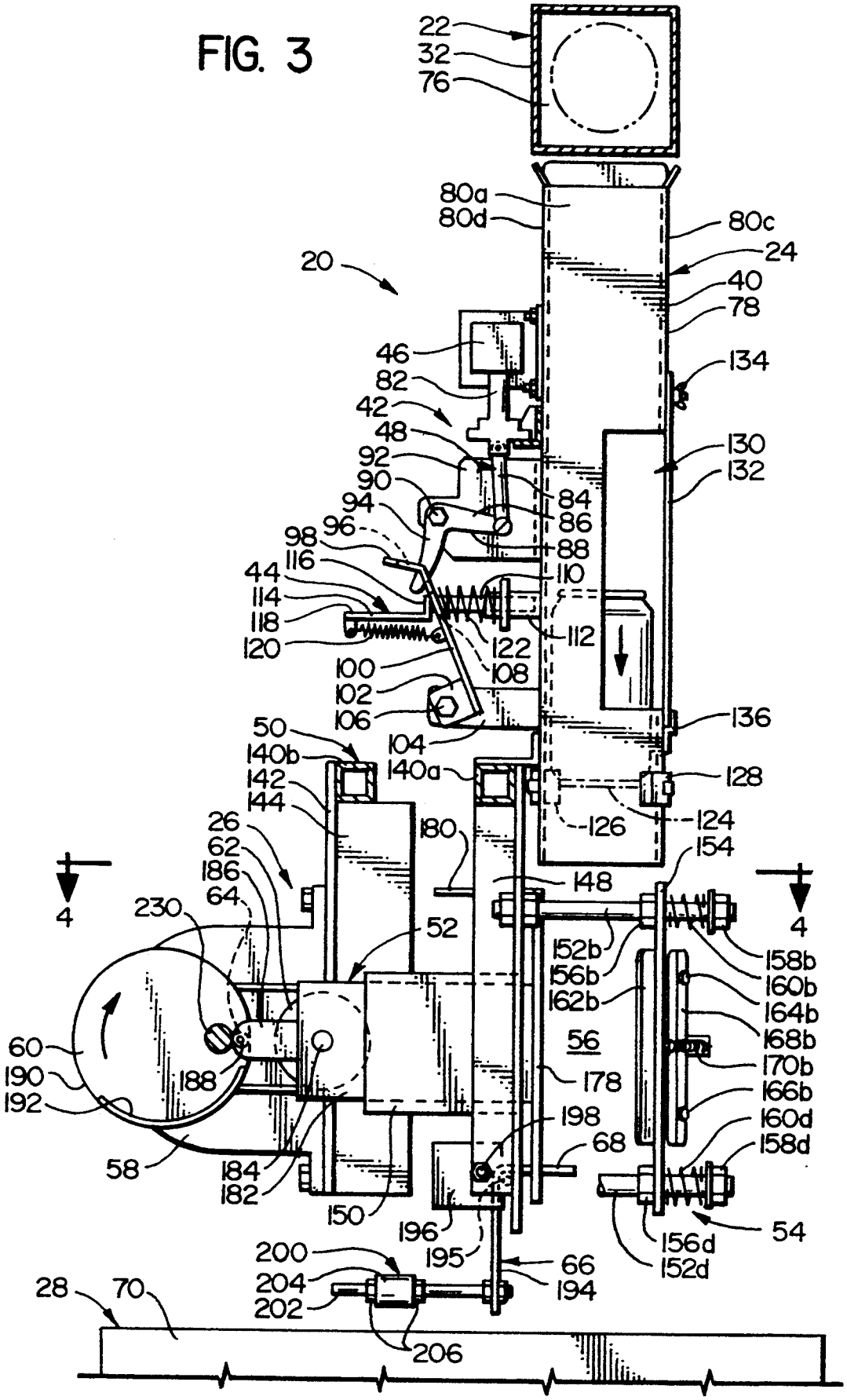
FIG. 3 is a front elevational view, partly in section, of the mechanism of FIG. 2, looking towards this from the right in the view shown in FIG. 2.

The compound cam is eccentrically mounted to the motor output shaft, the direction of rotation being indicated by the arrow in FIG. 3. As will be described in greater detail below, the thrust cam surface first rotates into engagement with the thrust roller 62 so as to drive the ram longitudinally through its guide towards the crusher plate subassembly, and then further rotation of the cam brings the return cam face in front of return arm roller 64 so as to draw the ram back to its retracted position. A suitable compound cam 60, as shown, can be constructed from a section of pipe with a cam plate and keyway being mounted inside this. For example, a length of pipe can be cut, and the first half of this (lengthwise) can be retained for the thrust cam surface, while over the remaining length of the pipe the wall is partially cut away so that what is left forms the return cam surface. A circular plate with a cutout for the keyway is then welded within this, and the keyway is mounted in the cutout so as to be positioned adjacent the exit end of the return cam surface, (see FIG. 3).

Figure 4:
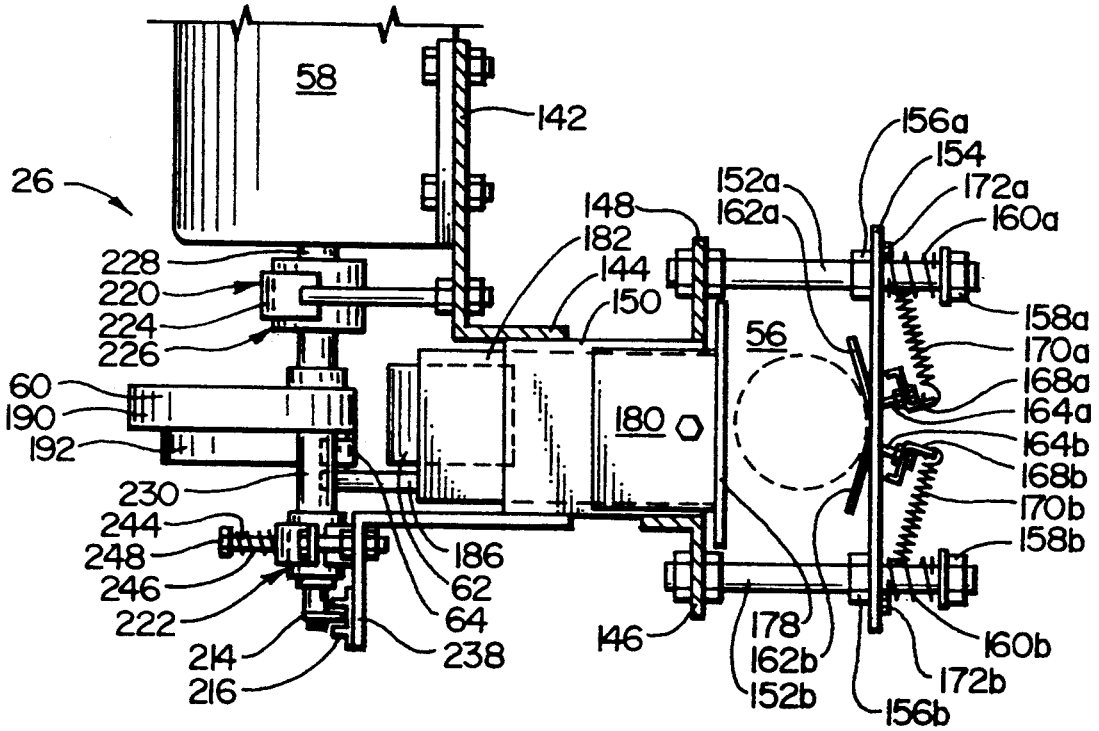
FIG. 4 is an overhead plan view, taken along line 4—4 in FIG. 3.
Figure 9:
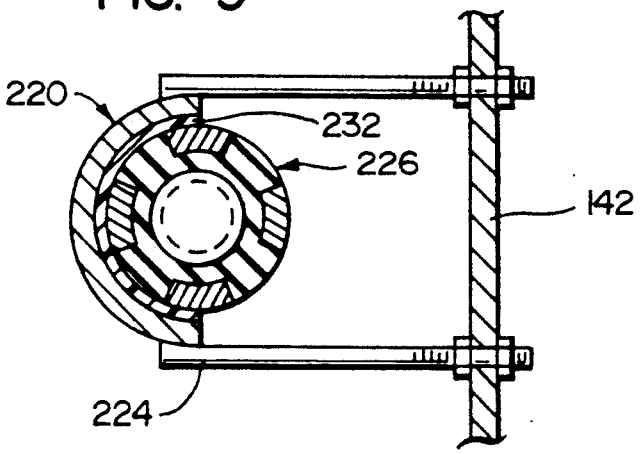
FIG. 9 is a cross-sectional view showing a coupling in the cam drive shaft, and a bearing which supports this.
Figure 10:
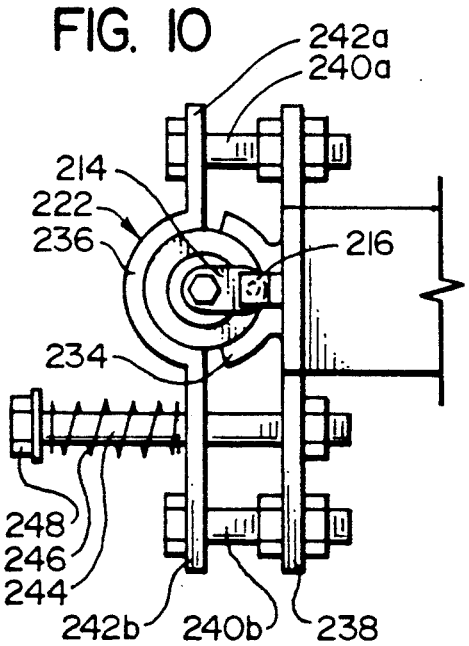
FIG. 10 is an end view of this shaft assembly showing a second bearing which supports the end of this, and also a blade which is rotated through a shut-off sensor to secure operation of the machine.
Figure 11:
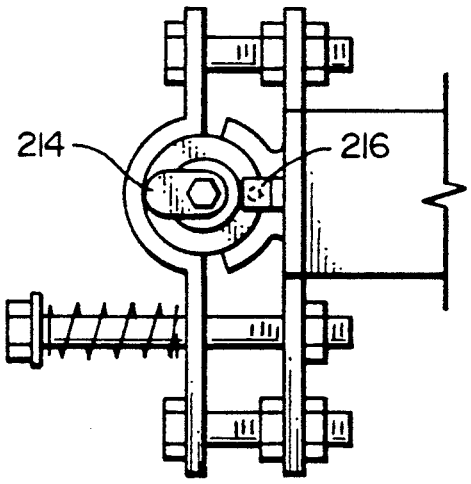
FIG. 11 is a view similar to that of FIG. 10, showing the blade rotated away from the cut-off sensor.

As noted above, the compound cam which has just been described is mounted to the output shaft of the electric motor. Being that the cam will be required to apply considerable force to ram, it is important that this shaft be well supported to withstand reaction loading. Accordingly, as is seen in FIGS. 2 and 4, and in greater detail in FIGS. 9–11, there are first and second outrigger bearings 220 and 222 mounted to the framework members to support the drive shaft assembly. The first of these is mounted to support bracket 142 by means of a strap 224, and this supports the shaft assembly at the coupling 226 (see FIG. 9) which joins the motor shaft 228 to the jack shaft 230 to which the cam is actually mounted; being that the reaction loading on the shaft at this point will be in the outward direction (i.e., away from the can chute) the bearing 220 itself may be formed as a semi-circular insert 232 positioned on the outer side of the coupling.

The second bearing 222 supports the outer end of the jack shaft, and this is made up of first and second semi-circular bearing shells 234 and 236. The former is fixed to a bracket 238 so as to bear against the inside of the shaft (i.e., toward the chute). The outer shell, in turn, is semi-floating, being supported for some movement on bolts 240*a*, 240*b* which extend from bracket 238 through bores in a pair of ears 242*a*, 242*b* on the bearing shell. A third bolt 244 also extends from bracket 238 through a bore in one of the ears, and there is a compression spring mounted around the shaft of this between the head 248 of the bolt and the ear so as to bias the bearing shell against the outside of the shaft. This arrangement provides very sturdy support for the shaft assembly, while the combination of the semi-floating bearing 222 and coupling 226 permit the jack shaft to absorb some of the shock and vibration which is received by the compound cam without passing this on to the motor shaft.

The final component of crusher mechanism assembly 26 is the can stop subassembly 66. As was noted above, this comprises a trapfall stop 68, which projects into the pathway of the cans directly beneath the crushing zone 56, so as to retain these in the zone for crushing. However, the purpose of this is to retain only empty cans in the crushing zone, while rejecting or "scavenging" partly full cans (or other heavy objects) so as to prevent these from fouling or damaging the assembly. The stop is formed by one of two right-angle legs of a swinging link 194, which is mounted by a pivot pin 195 to a support bracket 196, this in turn being mounted to frame brackets 146, 148 by a bolt 198.

The stop 68 (i.e., the upper leg of the swinging link) is bifurcated so that there are first and second prongs which support the can. Since the stop extends through the platen 178, this arrangement makes it possible to retain a tongue portion 178*a* of the platen (see FIG. 2) which extends beneath the stop, and prevents the can from curling around the stop and becoming stuck on this as the can is crushed.

The lower leg of the swinging link, in turn, normally extends downwardly from the pivot pin, and a counterweight 200 is mounted to this. The counterweight is made up of a threaded shaft 202 which extends horizontally from the lower leg, and a sleeve weight 204 which slides onto this. Locking nuts 206 on either end of the weight locate it along the shaft, and this permits the resistance which is offered by the trapfall stop to be adjusted so that this will arrest objects of a known weight dropping out of the chute assembly. Then, when objects of greater weight (e.g., partially full cans) strike the stop, this will pivot out of the way and the object will simply drop out through the bottom of the mechanism. Empty aluminum cans, however, will be retained, and once these have been flattened they will simply drop out through the gap between the end of the stop and the crusher platen 154. A particular advantage of this arrangement is that it allows the operator to decide to crush cans which contain more-or-less residual liquid depending on circumstances; for example, if the machine is in a location where it is frequently serviced, it may be decided to crush cans which are relatively full of liquid and simply clean up the resultant mess more often.

The vertical alignment of the trapfall stop below the discharge end of the chute assembly, through the vertically extending crushing zone 56, makes it possible to employ the momentum which is developed by the falling can to ensure positive action of this mechanism.

Container Assembly

The container assembly 28 may comprise one or more containers of any suitable kind. However, as noted above, it has been found preferably to employ large plastic or rubber trash cans for this purpose, since they can hold a large number of flattened cans, are easy to handle, and reduce the possibility of spilled liquid both in the machine and during transport.

Sequence of operation

Having provided a description of the assemblies which make up mechanism 20, the sequence of operations which they go through to receive cans and crush these one-by-one will now be described.

Figure 5:
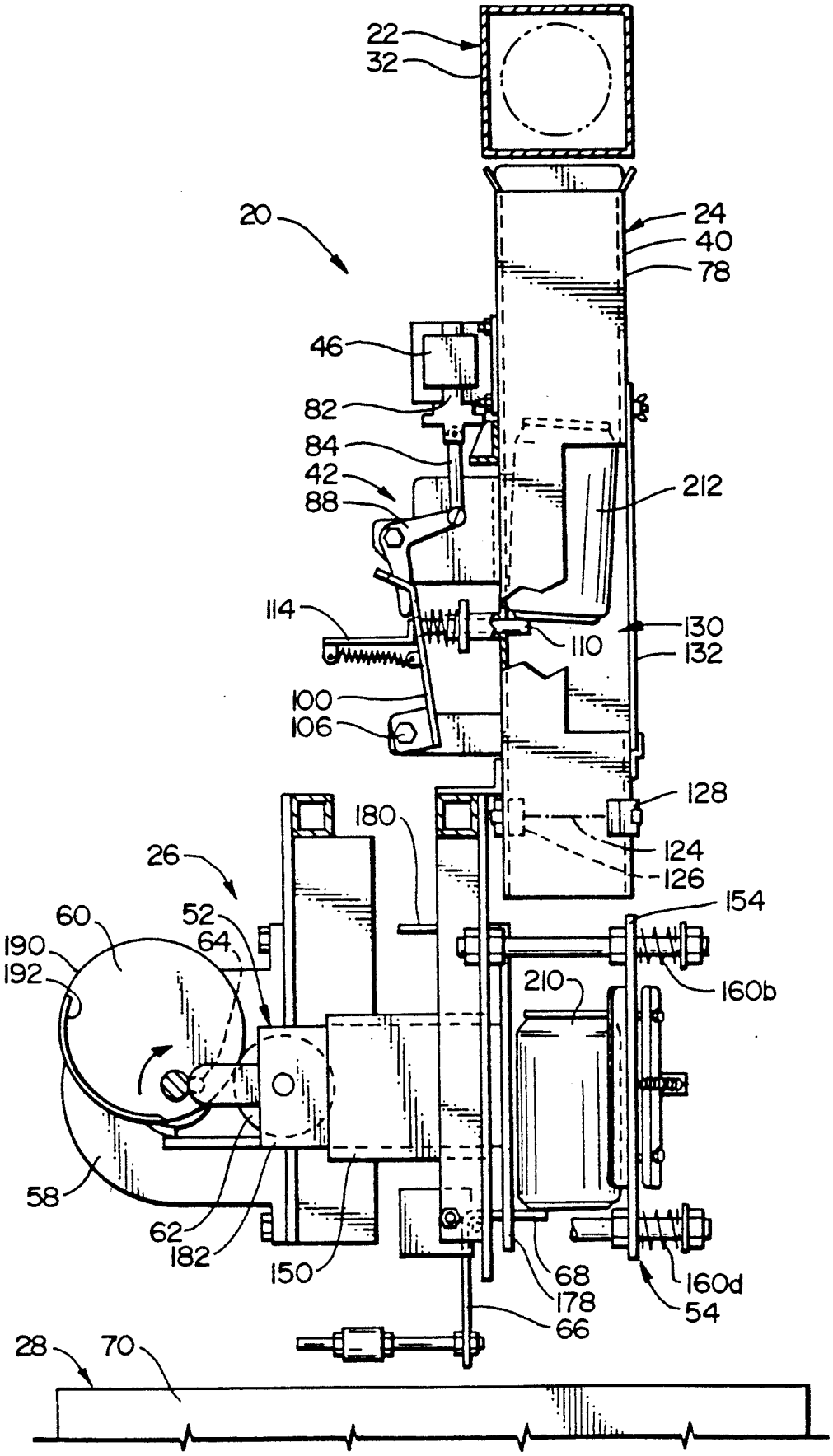
FIG. 5 is a view similar to that of FIG. 2, showing a first can positioned within the crushing zone at the beginning of the crushing cycle, and a second can being retained by the feed mechanism in the entry chute.

As discussed above, the cans enter the system through the entry tube assembly, and then drop vertically through the guide chute assembly 24. The IR beam 124 formed between source 126 and detector 128 (also referred to hereinafter as the "on sensors") extends across the chute near the bottom of this. Therefore, as a first empty can 210 drops through the chute, it breaks the IR beam before falling into the crushing zone 56 and being arrested by stop 68. When the IR beam is broken, this generates a signal to an electrical control unit (not shown) which initiates operation of the electromechanical components of the system. Firstly, a signal is generated which actuates solenoid 46. In response to this, the solenoid withdraws actuator rod 82 and link 84 so as to rotate cranked link 88 in a counterclockwise direction; this pivots draw link 100 towards the chute assembly, driving the rod portion 110 of the stop into the interior of the chute. This retains any cans (such as the second can 212 shown in FIG. 5) which may have followed the first can into the chute, so that these can be crushed singly in their turn.

Figure 6:
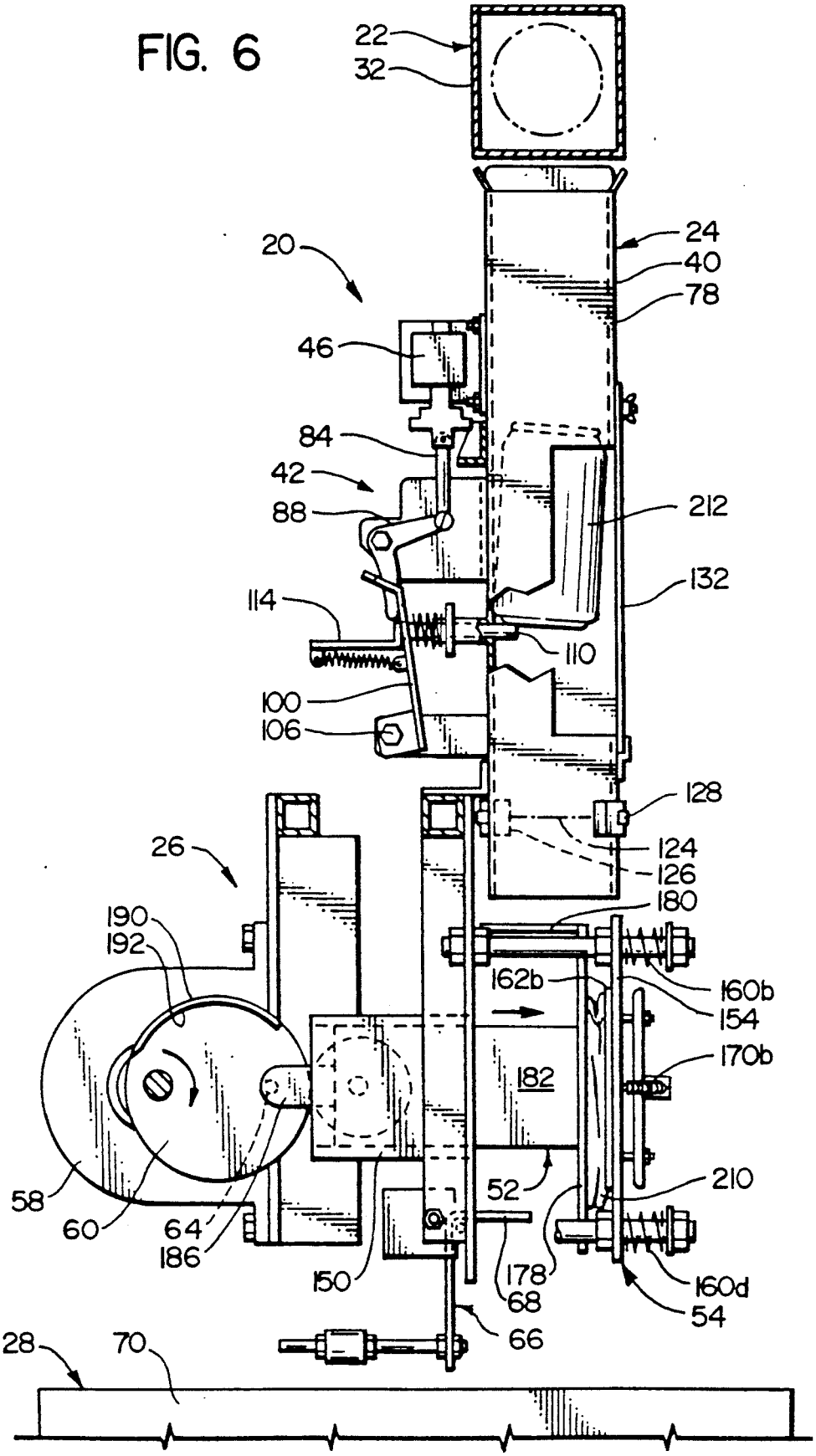
FIG. 6 is a view similar to FIG. 5, showing the ram of the crushing assembly having been fully extended by rotation of the motor-driven cam so as to compact the first can in the crushing zone.

Also in response to the initiation signal, the control assembly actuates the motor of the crushing mechanism. The ram assembly at this point is in its initial, retracted position, and as the motor rotates cam 60 in a clockwise direction (as shown), the thrust cam face 190 is driven against the main thrust roller 62 of the ram. Continued rotation of the cam "lobe" drives the ram through guide 150 in the direction indicated by the arrow in FIG. 6. The can 210 is thus crushed between the platens 178 and 154, and as this is done, the two guide wings 162*a*, 162*b* flatten out in the manner previously described above. Also, crushing platen 154 gives way to a certain degree, as springs 168*a–d* are compressed by the loading on the platen, which provides a shock-absorbing effect: as the can collapses, it usually does not do so in a smooth, continuous manner, but rather tends to fail in abrupt and uneven stages, and the springs absorb the resultant shocks and prevent these loads from being transmitted into the ram drive mechanism. In particular, this prevents the shock loading from being transmitted at the interface between the cam and thrust roller, and so greatly enhances the working life of these components. Also, it may occur that some non-collapsible article is inserted into the system (whether accidentally or by a vandal) and this is not rejected by can stop subassembly 66. In this case, the springs will permit the platen 154 to be displaced a sufficient distance (e.g., ¼inch) that this contacts a shut-off switch (not shown) which stops the motor so as to prevent damage to the crushing mechanism.

Figure 7:
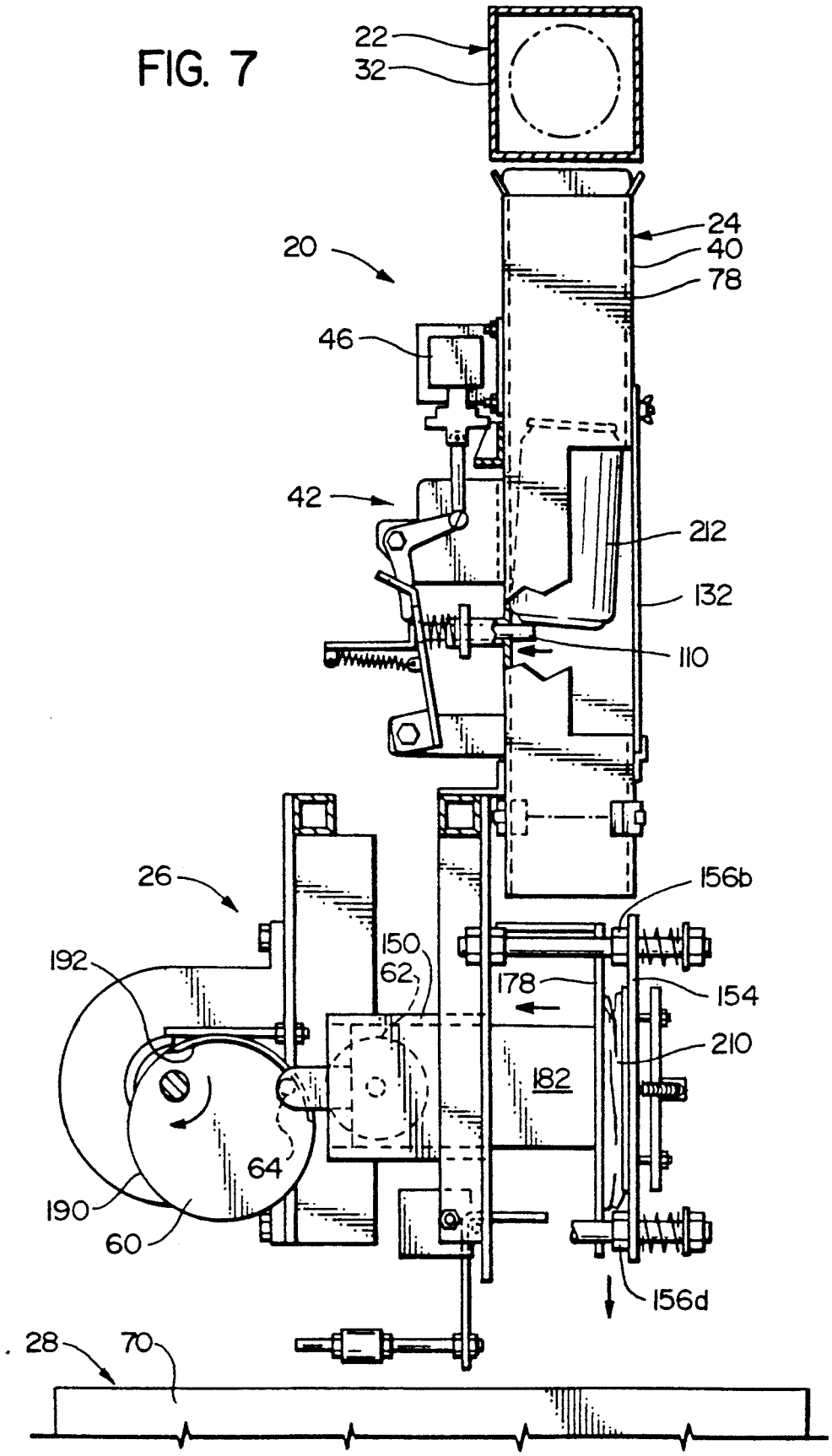
FIG. 7 is a view similar to FIGS. 5–6, showing the motor-driven cam have been rotated to begin the retraction stroke of the ram, during which the crushed can will be released out of the bottom of the assembly and the second can will be released into the crushing zone.

At the completion of the extension stroke, the can 210 is flattened thin enough that this will slip out through the gap between the stop and crushing platen 154 as the ram is retracted. This is accomplished by continued rotation of cam as is shown in FIG. 7, so that the convex return cam face 192 hooks behind the return arm roller 64 and begins to draw this in the reverse direction, retracting the ram back through guide 150. Platen 154 initially follows this movement as the compression springs expand, but when this contacts stop nuts 156*a–d*, the platen 178 on the ram moves away from the can and releases this from frictional engagement so that the can falls out through the bottom of the assembly.

At the end of the return stroke, the return arm roller 64 exits the crescentic return cam, and the ram is positioned in readiness for another extension stroke. Also, an actuator blade 214 which is mounted on the end of jack shaft 230 rotates through an "off" sensor 216 mounted on bracken 238 (see FIGS. 10–11), which may be provided by a conventional electric eye. This generates a signal to the control assembly, which shuts down motor 58 in response to this. This also actuates solenoid 46 to extend the actuator rod and retract stop 112, as seen in FIG. 7. This releases the second can 212 (if present), so that this falls through the bottom of the chute, breaks the IR sensor beam 124, and re-initiates the sequence. If, however, no other cans are being held in the chute, stop 44 simply remains in the retracted position until another can is inserted into the machine and drops through the chute.

Figure 8:
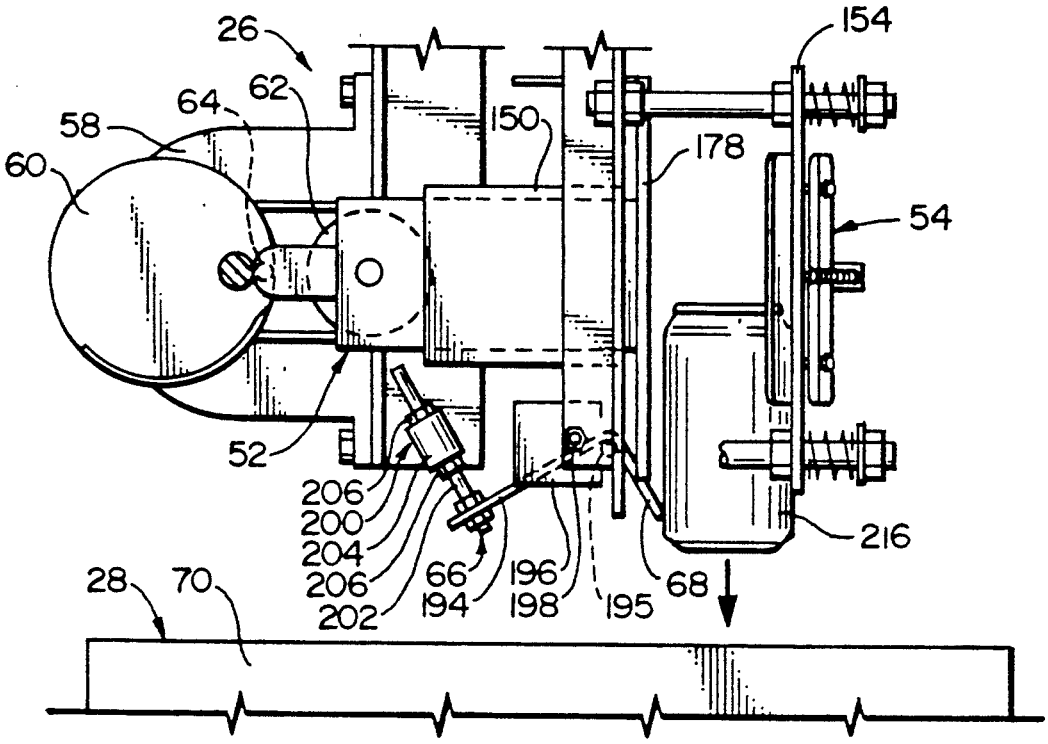
FIG. 8 is a view similar to FIG. 3, showing the lower end of the crushing zone, and the manner in which a full or partially full can passes through this without being crushed, by deflecting a counterbalanced stop mechanism.

FIG. 8 illustrates the action of the can stop subassembly in greater detail. As described above, an empty can falling onto stop 68 will rest on top of this without displacing the swinging link. If, however, a full or partly full can 216 lands on the trapfall stop, as is shown in FIG. 8, the additional weight imparted by the liquid will cause the stop to rotate downwardly around pivot pin 194 and out of the path of the can, so this can drop straight into container 70. The crusher mechanism, having been actuated by the can passing through the IR sensor beam, goes through the crushing cycle, but the full can 216 will have already passed through the crushing zone and left this before the crushing platens move together.

The invention may be embodied in other specific forms without departing from the spirit or essential characteristics thereof. For example, the "electronic eye" sensors described above are generally preferred over electromechanical switches because of this speed—e.g., the speed of the electronic eye sensors make it possible to mount the "on" sensor at the bottom of the can chute and just above the crushing zone—but one may choose to use electromechanical or other sensors in some embodiments. Accordingly, the present embodiments are to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. Apparatus for collecting and storing empty aluminum containers, said apparatus comprising:

a reciprocating ram having a first crushing platen mounted at a first end thereof;

a second crushing platen mounted in opposition to said first crushing platen so as to define a vertically extending crushing zone intermediate said platens, said second crushing platen comprising:

a generally planar plate member having a first face for receiving a crushing force exerted by said reciprocating ram; and first and second guide plates mounted to said plate member and extending from said first face thereof into said crushing zone;

said guide plates being angled outwardly from said plate member along their vertically extending outer edges and inwardly along their vertically extending inner edges so as to form a V-shaped channel for guiding and holding a container which falls vertically into said crushing zone;

means for reciprocating said ram between a retracted position in which said crushing zone is opened to receive a container therein and an extended position in which said platens are brought together so as to crush a container received in said zone;

a feed chute for holding a plurality of said containers, said chute having a discharge end positioned vertically above said crushing zone;

means for releasing said containers individually from said chute in response to said ram moving to said retracted position, so that said containers fall vertically one-by-one into said opened crushing zone; and means for retaining an empty container within said zone for crushing, and for releasing a container after crushing so that said crushed container falls vertically out of the bottom of said crushing zone.

2. The apparatus of claim 1, wherein said means for reciprocating said ram comprises:

rotational drive means; and cam means operatively interconnecting said drive means and said ram for reciprocating said ram in response to operation of said drive means.

3. The apparatus of claim 2, wherein said cam means comprises:

a compound eccentric cam comprising:

a) a first cam portion having a generally convex thrust cam face; and b) a second cam portion having a generally concave return cam face; and a compound follower assembly mounted to said ram and comprising:

a) a first follower portion for engaging said convex thrust cam face so as to extend said ram in response to rotation of said cam to a first angular position; and b) a second follower portion for engaging said concave return cam face so as to retract said ram in response to rotation of said cam to a second angular position.

4. The apparatus of claim 3, wherein said compound eccentric cam has a generally cylindrical wall;

said convex thrust cam face comprising an outer surface of a first portion of said cylindrical wall; and said concave return cam face comprising an inner surface of a second portion of said cylindrical wall.

5. The apparatus of claim 4, wherein said first follower portion comprises:

a first roller follower mounted to a second end of said ram for engagement by said outer surface of said cylindrical wall of said cam as said cam rotates to said first angular position.

6. The apparatus of claim 5, wherein said second follower portion comprises:

a second roller follower; and an extension arm having a first end mounted to said ram and a second end positioned adjacent said compound cam, said second roller follower being mounted to said second end of said extension arm so as to extend within said wall of said cam, so that said second follower is engaged by said inner surface of said wall as said cam rotates said second angular position.

7. The apparatus of claim 6, wherein said rotational drive means comprises:

an electric motor having a drive output shaft mounted eccentrically to said cam.

8. The apparatus of claim 1, wherein said second crushing platen further comprises:

means for absorbing shock loading imparted to said plate member so as to reduce transmission of said shock loading into said means for reciprocating said ram.

9. The apparatus of claim 8, wherein said means for absorbing shock loading comprises:

means for supporting said plate member for displacement by said loading; and at least one spring mounted against a second face of said plate member for compression as said plate member is displaced by said loading.

10. The apparatus of claim 9, wherein said means for supporting said plate member for displacement by said shock loading comprises:

at least one support rod received in a cooperating bore in said plate member so as to permit displacement of said plate member along said rod in an outward direction from said crushing zone;

said support rod having a stop portion on an outer end thereof, said spring being mounted around said rod intermediate said stop portion of said rod and said second face of said plate member.

11. The apparatus of claim 1, wherein said guide plates are yieldingly biased to form said V-shaped channel, so that said outwardly angled edges of said guide plates yield inwardly as a container is crushed against said second platen, until said guide plates lie generally flat against said first face thereof.

12. The apparatus of claim 1, wherein said means for retaining an empty container in said crushing zone comprises:

means for retaining said empty container in said crushing zone and for permitting at least a partially full container to pass through said zone without crushing.

13. The apparatus of claim 12, wherein said means for retaining said empty container in said crushing zone and permitting said at least partially full container to pass therethrough comprises:

a container stop which extends at least partway across a lower end of said crushing zone, said stop being configured to arrest an empty container falling thereon, but to be displaced downwardly under an at least partially full container falling thereon and out of the path thereof.

14. The apparatus of claim 13, wherein said container stop comprises:

a pivotably mounted swinging link having a first leg configured to extend at least partway across said lower end of said crushing zone and a second leg; and a counterbalance mounted to said second leg of said swinging link for yieldingly biasing said link to a position in which said first leg extends across said lower end of said crushing zone.

15. The apparatus of claim 14, further comprising:

means for selectively adjusting a position of said counterweight on said second leg of said link so as to selectively vary the resistance which is offered by said stop to a container falling thereon.

16. Apparatus for collecting and storing empty aluminum containers, said apparatus comprising:

a reciprocating ram having a first crushing platen mounted at a first end thereof;

a second crushing platen mounted in opposition to said first crushing platen so as to define a vertically extending crushing zone intermediate said platens;

means for reciprocating said ram between a retracted position in which said crushing zone is opened to receive a container therein and an extended position in which said platens are brought together so as to crush a container received in said zone;

a feed chute for holding a plurality of said containers, said chute having a discharge end positioned vertically above said crushing zone;

means for releasing said containers individually from said chute in response to said ram moving to said retracted position, so that said containers fall vertically one-by-one into said opened crushing zone, said means for releasing said containers individually comprising:

a stop having an inner end configured to arrest said containers in an interior passage of said chute;

solenoid means operatively connected to said stop for extending said end of said stop in response to an initiation signal, and for withdrawing said stop in response to a termination signal; and means for selectively generating said initiation signal, and means for selectively generating said termination signal, so that said containers fall out of said chute one-by-one as said stop is extended and withdrawn by said solenoid means; and means for retaining an empty container within said zone for crushing, and for releasing a container after crushing so that said crushed container falls vertically out of the bottom of said crushing zone.

17. The apparatus of claim 16, wherein said means for generating said initiation signal is configured to generate said initiation signal in response to a container falling out of said lower end of said chute.

18. The apparatus of claim 17, further comprising:

means responsive to said initiation signal for actuating said means for reciprocating said ram, so that said ram is reciprocated to crush said container in response to a container falling out of said lower end of said chute and into said crushing zone.

19. The apparatus of claim 18, wherein said means for generating said initiation signal comprises:

sensor means mounted in said lower end of said chute below said end of said stop, for detecting passage of a container through said lower end of said chute and generating said initiation signal in response thereto.

20. The apparatus of claim 19, wherein said sensor means comprises:

a light source for generating a light beam across said lower end of said chute; and a light sensor for receiving said beam and for generating said initiation signal in response to interruption of said beam by passage of a container therethrough.

21. The apparatus of claim 20, wherein said feed chute is configured to align said containers so that said containers proceed axially through said interior of said chute.

22. The apparatus of claim 21, wherein said light source and sensor are configured to generate said beam across said chute at a distance below said end of said stop which is approximately equal to an axial length of said containers, so that as a bottom of a first container interrupts said beam so as to generate said initiation signal, said end of said stop is extended by said solenoid means in response to said initiation signal so as to abut a bottom of a second container positioned in said chute vertically adjacent said first container.

23. The apparatus of claim 22, wherein said means for generating said termination signal is configured to generate said termination signal in response to said ram moving to said retracted position so a to open said crushing zone.

24. The apparatus of claim 23, wherein said means for generating said termination signal comprises:

an actuator member mounted to said ram so as to reciprocate therewith; and a switch member configured to be actuated in response to said actuator member reciprocating with said ram to said retracted position.

* * * * *